United States Patent [19]

Hwang

[11] Patent Number: 4,990,008

[45] Date of Patent: Feb. 5, 1991

[54] REFILLABLE INK RIBBON CARTRIDGE FOR USE IN ELECTRONIC TYPEWRITER

[76] Inventor: Chiman Hwang, 28606 Pacific Hwy. S. 65, Federal Way, Wash. 98003

[21] Appl. No.: 426,670

[22] Filed: Oct. 26, 1989

[51] Int. Cl.[5] ..... B41J 35/28

[52] U.S. Cl. ..... 400/208; 400/693.1

[58] Field of Search ..... 400/194, 195, 196, 196.1, 400/197, 198, 199, 200–202.4, 248, 248.1, 250, 207, 208, 208.1, 693.1

[56] References Cited

U.S. PATENT DOCUMENTS

| | | | |
|---|---|---|---|
| 3,396,828 | 8/1968 | Moshier | 400/208.1 |
| 4,130,367 | 12/1978 | Guerrinni | 400/195 |
| 4,299,504 | 11/1981 | Benz et al. | 400/196 |
| 4,388,006 | 6/1983 | Waibel | 400/195 |
| 4,402,621 | 9/1983 | Abell | 400/196 |
| 4,406,553 | 9/1983 | Nally et al. | 400/208 |
| 4,448,556 | 5/1984 | Trezise | 400/196 |
| 4,609,298 | 9/1986 | Shioda | 400/208 |
| 4,655,623 | 4/1987 | Gasser | 400/208 |
| 4,780,011 | 10/1988 | Hasegawa | 400/208 |
| 4,830,524 | 5/1989 | Shore | 400/208 |
| 4,913,572 | 4/1990 | Behrens | 400/207 |
| 4,917,515 | 4/1990 | Piller et al. | 400/208 |

FOREIGN PATENT DOCUMENTS

| | | | |
|---|---|---|---|
| 3524057 | 1/1987 | Fed. Rep. of Germany | 400/208 |

*Primary Examiner*—David A. Wiecking
*Assistant Examiner*—Joseph R. Keating
*Attorney, Agent, or Firm*—Birch, Stewart, Kolasch & Birch

[57] ABSTRACT

A refillable ink ribbon cartridge for use in an electronic typewriter which includes a housing, a feed spool member having symmetric C-shaped springs for slidably receiving and removing a changeable feed spool, a winding spool member having a lever and a lever opener for slidably inserting and removing a winding spool, and a jagged wheel whereby the used ink ribbon cartridge can be reused and maintains a constant tension on the ink ribbon between the feed and winding spools.

20 Claims, 7 Drawing Sheets

FIG. 1
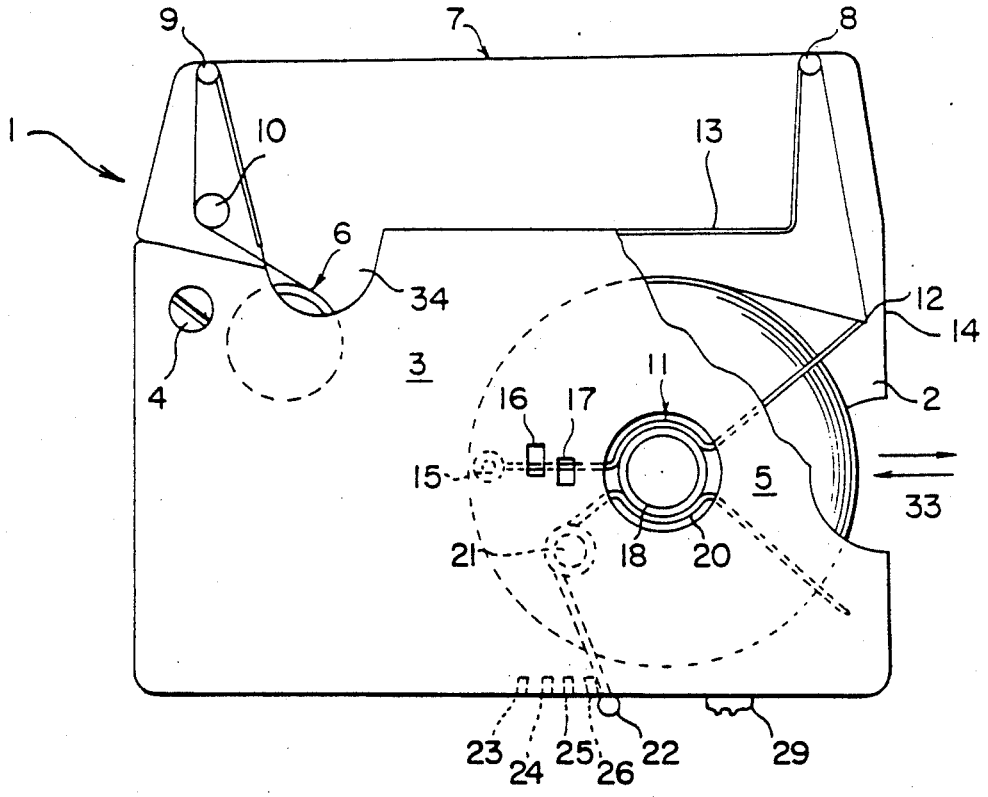
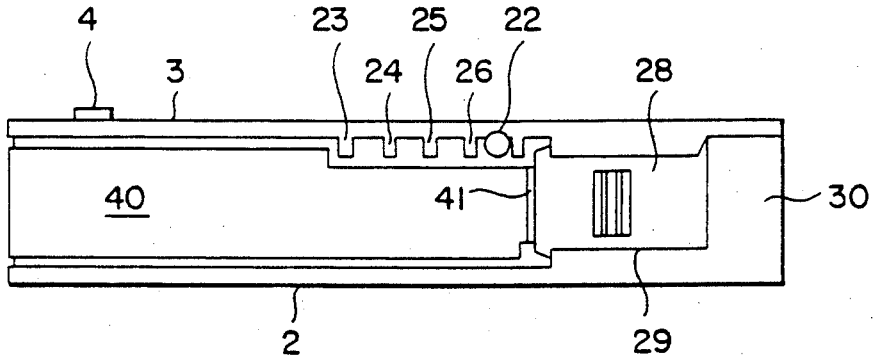
FIG. 2

REFILLABLE INK RIBBON CARTRIDGE FOR USE IN ELECTRONIC TYPEWRITER

BACKGROUND OF THE INVENTION

1. Field of the Invention

The present invention relates to a refillable ink ribbon cartridge for use in an electronic typewriter or a printer and more particularly, to an ink ribbon cartridge for use in an electronic typewriter which includes a changeable feed spool replaced through a side opening and a winding spool about which is wound a used ribbon which is taken out of the cartridge through a bottom opening of the cartridge, whereby the used cartridge can be reused without creating waste materials.

2. Description of the Prior Art

Various types of disposal ink ribbon cartridges are well known in the art. For example, in such disposal ink ribbon cartridges, the feed spool and the winding spool are operatively maintained the resilience of an ink ribbon by a feed spool spring as described in U.S. Pat. No. 4,406,554 to Nally et al and U.S. Pat. No. 4,655,623 to Gasser. However, such ink ribbon cartridges are incapable of allowing replacement of the feed spool and must be thrown away with the used ribbon after one use so as to create large amounts of waste materials.

SUMMARY OF THE INVENTION

Accordingly, it is an object of the present invention to provide a refillable ink ribbon cartridge for use in an electronic typewriter.

Another object of the present invention is to provide an ink ribbon cartridge which includes a changeable feed spool replaced through a side opening and a winding spool about which is wound a used ribbon which may be removed therefrom through a bottom opening of the cartridge.

A further object of the present invention is to provide a refillable ribbon cartridge which includes a feed spool member having symmetric C-shaped springs for slidably receiving and removing a feed spool, and a winding spool member having a lever and a lever opener for slidably inserting and removing a winding spool whereby the ribbon cartridge can be reused.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a refillable ink ribbon cartridge for use in an electronic typewriter which includes a housing, a feed spool member having symmetric C-shaped springs for slidably receiving and removing a changeable feed spool, a winding spool member having a lever and a lever opener for slidably inserting and removing a winding spool, and a jagged wheel whereby the used ink ribbon cartridge can be reused and maintains a constant tension on an ink ribbon between the feed and winding spools.

BRIEF DESCRIPTION OF THE DRAWINGS

The present invention will become more fully understood form the detailed description given hereinbelow and the accompanying drawings which are given by way of illustration only, and thus are not limitative of the present invention, and wherein:

FIG. 1 is a front elevational view of a refillable ink ribbon cartridge according to the present invention showing in cut away portions thereof a feed spool biased against first and second feed spool springs;

FIG. 2 is a bottom plan view of FIG. 1;

DESCRIPTION OF THE PREFERRED EMBODIMENTS

Figure 3:
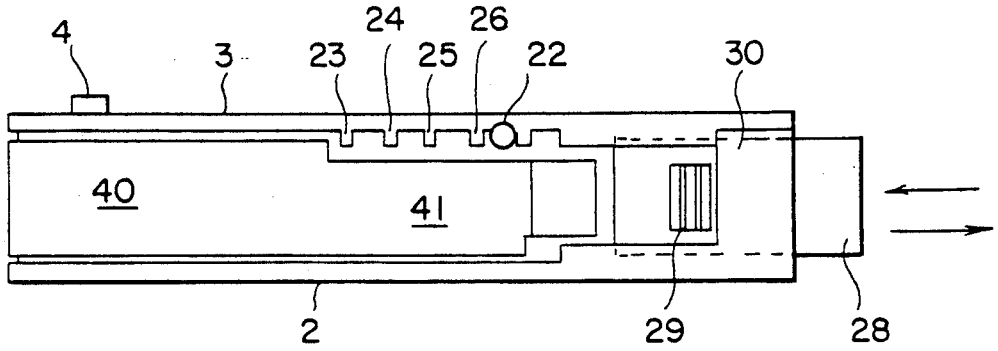
FIG. 3 is a bottom plan view of FIG. 1 showing an extended lever opener.

Referring now in detail to the drawings for the purpose of illustrating preferred embodiments of the present invention, the refillable ink ribbon cartridge 1 as shown in FIG. 1-5 comprises a housing including a casing base 2, a front casing cover 3, a C-shaped top cover 13, a winding spool side wall 55, a bottom plate 30, a feed spool member including a feed spool 5, a winding spool member including a winding spool 6 disposed within the housing, and a drive roller 4 in the vicinity of the winding spool 6. The front casing cover 3 includes a hole 114 for checking a hub 18 of the feed spool 5 in the ribbon cartridge 1 (FIG. 7) and is made of transparent materials such as plastic, glass, or the like. Also, guide pins 8, 9, and 10 are supported on the casing base 2 for passing an ink ribbon 7 therethrough from the feed spool 5 to the winding spool 6. The C-shaped top cover 13 is provided with a gulf 34 in the vicinity of the winding spool 6 for easily connecting the ink ribbon 7 to the winding spool 6 by the use of a finger.

Figure 6:
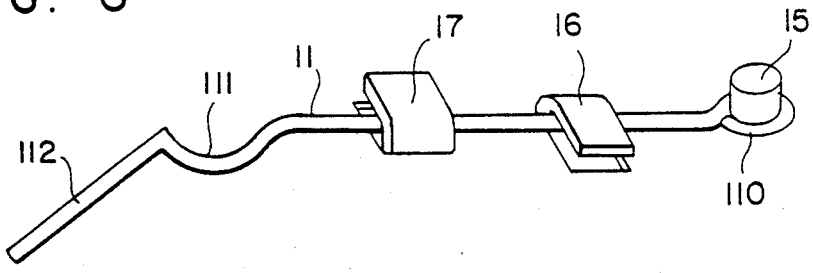
FIG. 6 is a perspective view of the first feed spool spring of the refillable ink ribbon cartridge according to the present invention.
Figure 7:
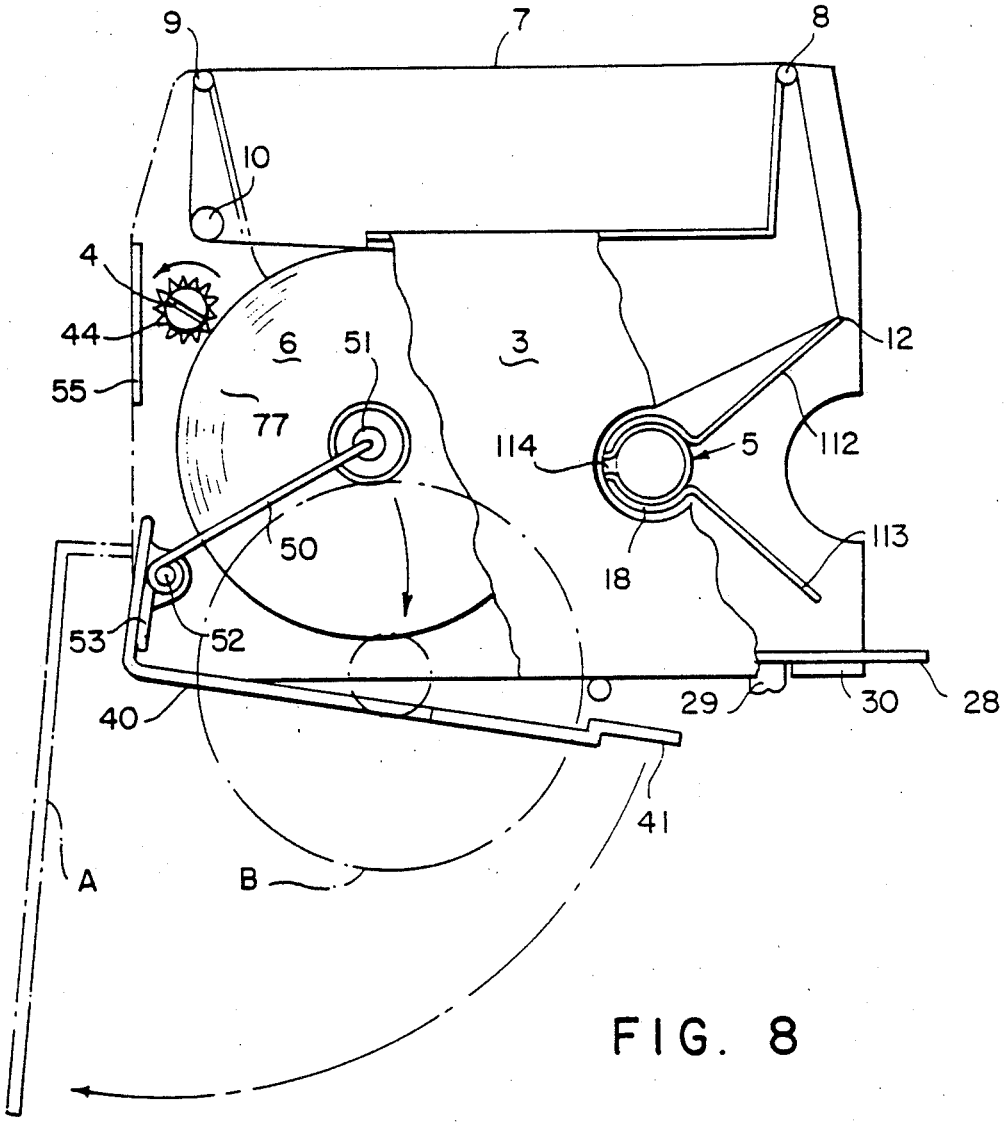
FIG. 7 is a front elevational view of FIG. 1 showing in cut away portions thereof a winding spool having an opened lever.
Figure 11:
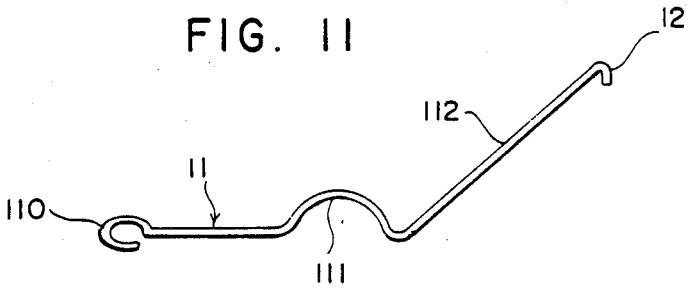
FIG. 11 is a top plan view of the first feed spool spring.
Figure 12:
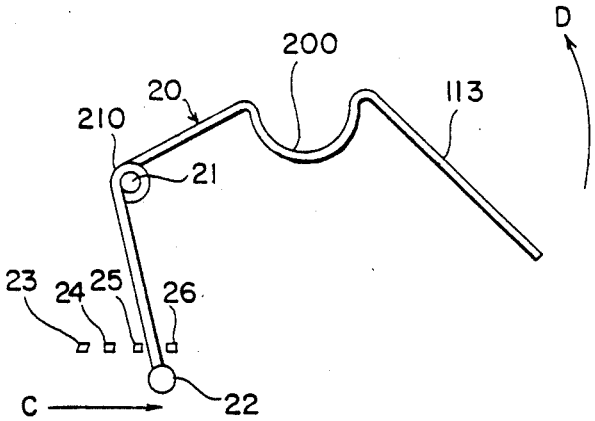
FIG. 12 is a top plan view of a second feed spool spring.

A feed spool side opening 14 is disposed on a feed spool side of the ribbon cartridge 1 for easily inserting and removing the feed spool 5 into and from the ribbon cartridge 1. The feed spool side opening 14 has a gulf 33 for easily inserting the feed spool 5 into the ribbon cartridge 1. As shown in FIGS. 6 and 11, a C-shaped first feed spool spring 11 pivotably connected to a fixed pin 15 through a pivotal spring ring 110 disposed at one end thereof is alternatively engaged in spring holders 16 and 17. Also, the first feed spool spring 11 has a semi-circle 111 disposed around the center thereof and extends a spring arm 112 and a hook 12 at the other end thereof for passing the ink ribbon 7 therethrough and maintaining a constant tension on the ink ribbon 7 between the feed spool 5 and the winding spool 6. As shown in FIGS. 7 and 12, a C-shaped second feed spool spring 20 symmetrically disposed at the C-shaped first feed spool spring 11 is pivotably connected to a fixed pin 21 through a pivotal spring ring 210 thereof. Also the second feed spool spring 20 is provided with an end engagement 22 at one end thereof for readily engaging with a plurality of stoppers 23, 24, 25, and 26 disposed on the inside surface of the front casing cover 3 of the cartridge 1 for stopping the spring arm 22 between the stoppers 23 and 24, 24 and 25, or 25 and 26 so as to give a constant biasing force to the semi-circle 200 for tight positioning against the hub 18 of the feed spool 5 (FIGS. 2 and 3). The second feed spool spring 20 has a semi-circle 200 disposed around the center thereof and extends a spring arm 113. The spring arm 112 of the first feed spring 11 and the spring arm 113 of the second feed spring 20 define an angle of 60° to 90° therebetween (FIGS. 1 and 7). Thus, the feed spool 5 can be easily engaged between both semi-circles 111 and 200 of the first and second feed spool springs 11 and 20 through the hub 18 of the feed spool 5. The hole 114 disposed on the front casing cover 3 can easily look and check whether the hub 18 of the feed spool 5 containing both semi-circles 111 and 200 of the first and second feed spool springs 11 and 20 is located in the proper position or not.

Figure 4:
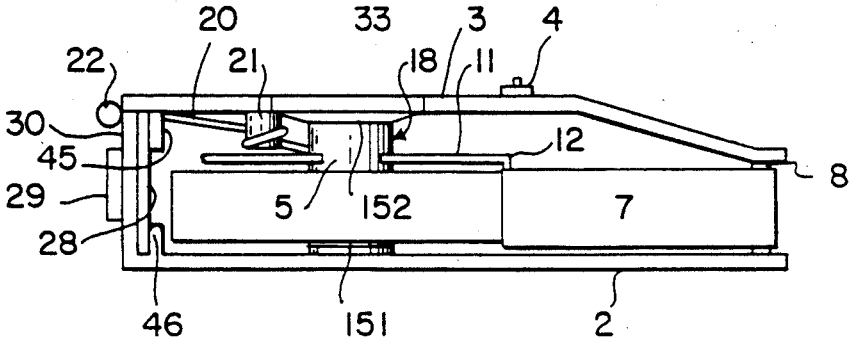
FIG. 4 is a right side elevational view of FIG. 1.
Figure 5:
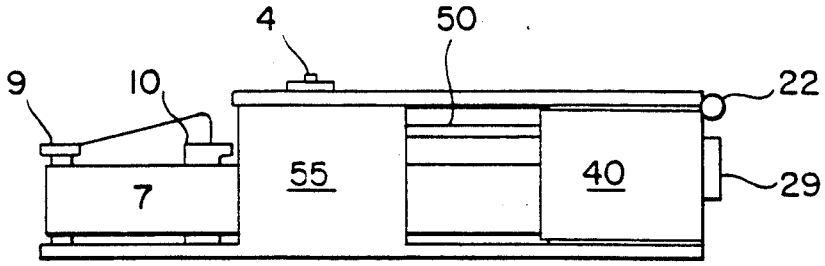
FIG. 5 is a left side elevational view of FIG. 1.
Figure 8:
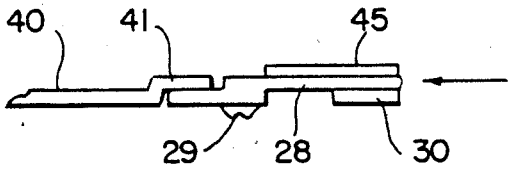
FIG. 8 is a bottom plan view of FIG. 1 showing a closed lever.
Figure 10:
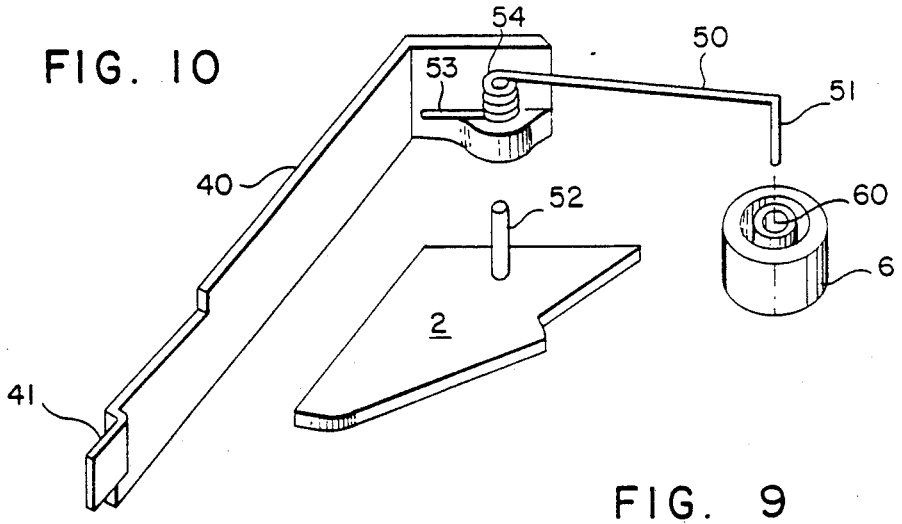
FIG. 10 is an exploded view of the winding spool member of the refillable ink ribbon cartridge according to the present invention.
Figure 9:
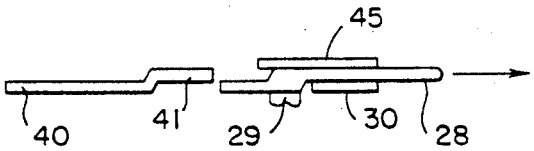
FIG. 9 is a bottom plan view of FIG. 1 showing an opened lever.

As shown in FIGS. 7, 8, 9, and 10, a fixed pin 52 supported on the casing base 2 receives a pivotal spring ring 54 of L-shaped spring 50. The spring 50 is engaged in a hub 60 of the winding spool 6 at one end 51 and biased against an L-shaped lever 40 at the other end 53 thereof (FIG. 10). The lever 40 has an L-shaped lever end 41 for locking with an edge of a lever opener 28 by pushing the lever opener 28 into the inside of the cartridge 1 in the direction indicated by an arrow from the open position shown in FIG. 7 to the closed position as shown in FIG. 8. Thereafter, when a finger stopper 29 of the lever opener 28 pushes into the outside of the ribbon cartridge 1, the lever 40 is released in the direction indicated by arrows from the closed position shown in FIG. 8 to the open position as shown in FIG. 9. Thus, the lever opener 28 is slidably engaged between the bottom plate 30 and both raised portions 45 and 46 (FIG. 4).

As shown in FIG. 7, the driver roller 4 has a jagged wheel 44 for resisting the used ribbon 7 of the winding spool 6 and maintaining a constant tension on the ink ribbon 7 between the feed spool 5 and the winding spool 6 so that the ribbon 7 from the feed spool 5 has a substantially constant resilient force.

Figure 13:
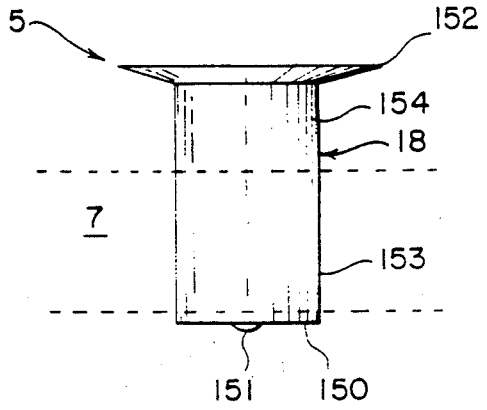
FIG. 13 is an enlarged, elevational side view of the feed spool of the refillable ink ribbon cartridge according to the present invention.

As shown in FIG. 13, the hub 18 of the feed spool 5 is provided with a global pin 151 disposed on the bottom plate 150 and a raised edge 152 disposed on the top plate thereof for preventing both semi-circles 111 and 200 of the first and second springs 11 and 20 from separating therefrom. The ink ribbon 7 is wound along a lower part 153 of the hub 18 of the feed spool 5.

Figure 14:
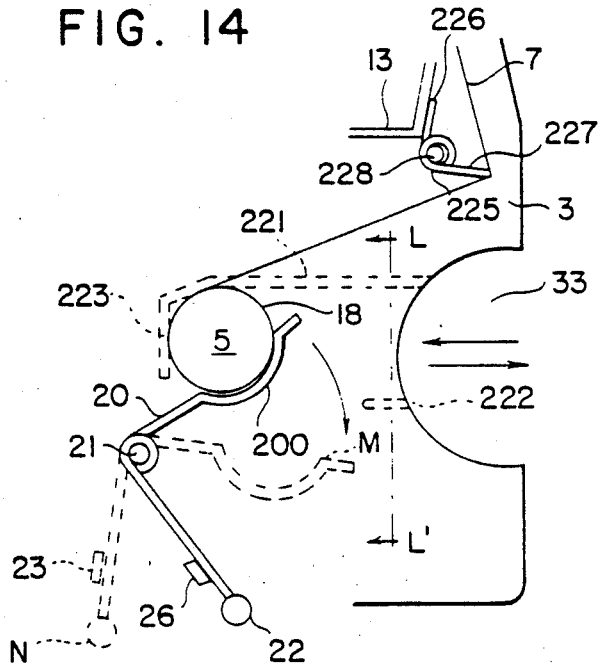
FIG. 14 is a front elevational view illustrating another embodiment of the feed spool member of the refillable ink ribbon cartridge according to the present invention.
Figure 15:
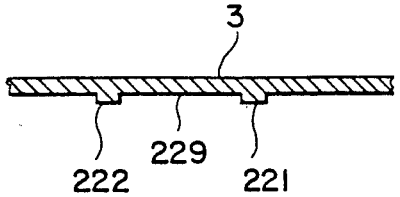
FIG. 15 is a cross sectional view of FIG. 14, taken along line L—L'.

Referring in detail to FIGS. 14 and 15, there is illustrated an another embodiment of an ink ribbon cartridge 1 according to the present invention. Instead of the first feed spool spring 11 of FIG. 1, bridges 221 and 222 and a stop bridge 223 maintain the position of the feed spool 5 for slidably inserting the feed spool 5 into the cartridge through a guide road 229 disposed between both bridges 221 and 222 (FIG. 15).

The plurality of stoppers 23, 24, 25, and 26 are disposed on the inside surface of the front casing cover 3 for stopping the spring arm 22 between the stoppers 23 and 24, 24 and 25, or 25 and 26 so as to give a constant biasing force to the semi-circle 200 for tight positioning against the hub 18 of the feed spool 5.

Figure 16:
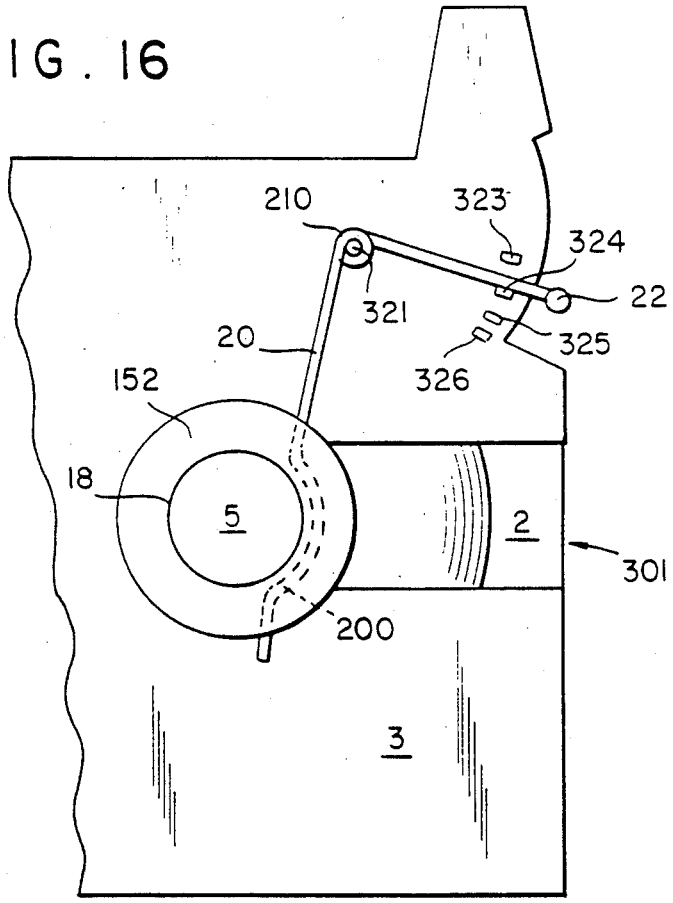
FIG. 16 is a front elevational view illustrating an additional embodiment of the feed spool member of a refillable ink ribbon cartridge according to the present invention.
Figure 17:
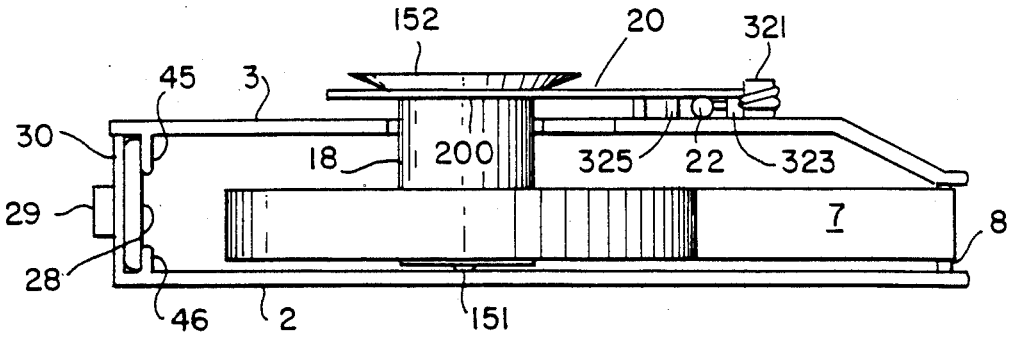
FIG. 17 is a right side elevational view of FIG. 16.

Referring in detail to FIGS. 16 and 17, there is illustrated an additional embodiment of an ink ribbon cartridge according to the present invention. In the ink ribbon cartridge 1 of FIG. 1, the C-shaped first feed spool spring 11 is removed and the C-shaped second feed spool spring 20 is disposed on the front casing cover 3. A fixing pin 321 is supported on the front casing cover 3 for pivotably receiving the spring ring 210 of the second feed spool spring 20. A plurality of stoppers 323, 324, 325, and 326 are supported on the front casing cover 3 for stopping the spring arm 22 between the stoppers 323 and 324, 324 and 325, or 325 and 326 so as to give a constant biasing force to the semi-circle 200 for tightly keeping a portion disposed below the raised edge 152 of the hub 18 of the feed spool 5. The feed spool 5 can be slidably inserted into the ribbon cartridge 1 through a space 301 disposed in the right side portion of the front casing cover 3. At that time, the raised edge 152 of the hub 18 and the second feed spool spring 20 come up over the front casing cover 3 (FIG. 17).

Figure 18:
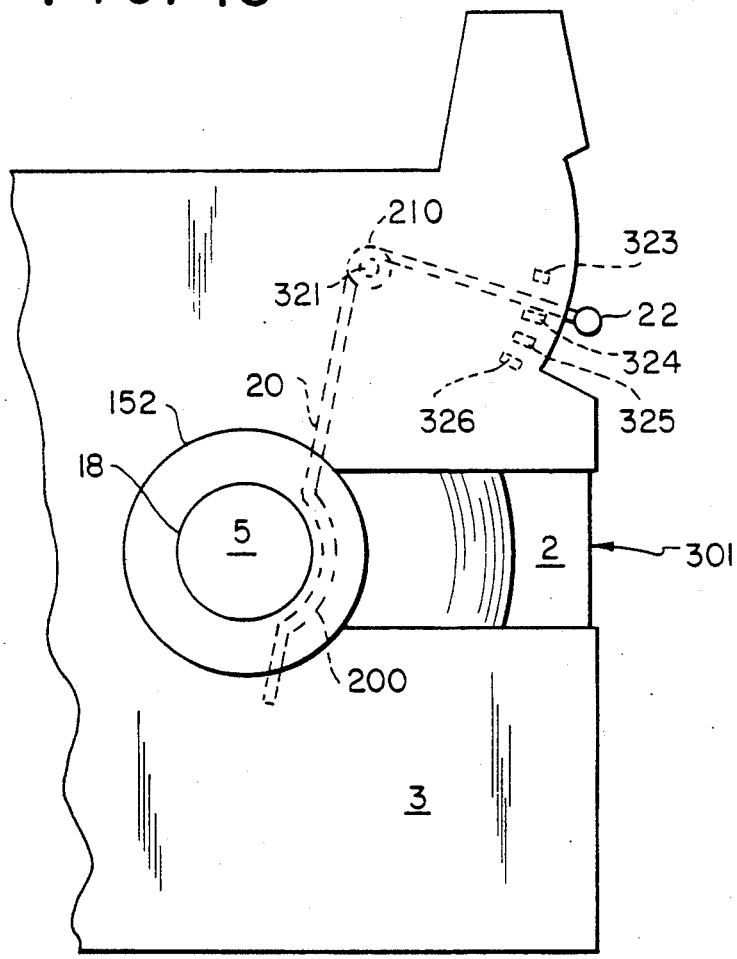
FIG. 18 is a front elevational view illustrating another additional embodiment of the feed spool member of a refillable ink ribbon cartridge according to the present invention.
Figure 19:
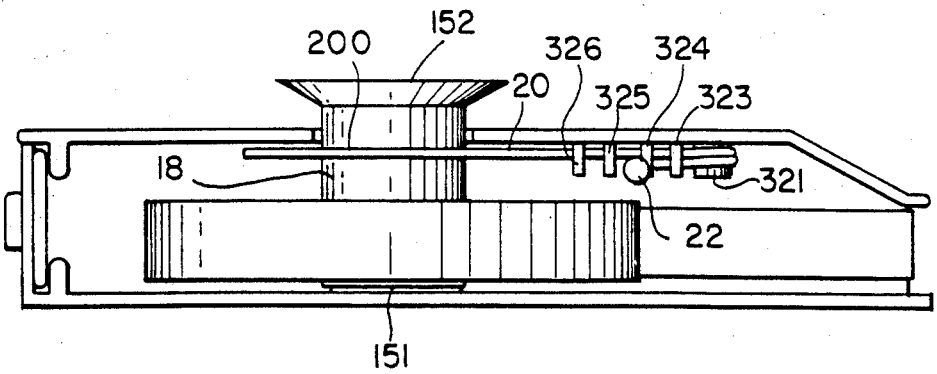
FIG. 19 is a right side elevational view of FIG. 18.

Referring in detail to FIGS. 18 and 19, there is illustrated another additional embodiment of an ink ribbon cartridge according to the present invention. In the ink ribbon cartridge of FIGS. 16 and 17, the C-shaped second feed spool spring 20 is disposed on the inside surface of the front casing cover 3. Accordingly, the fixing pin 321, and stoppers 323, 324, 325, and 326 are supported on the inside surface of the front casing cover 3. At this time, the raised edge 152 of the hub 18 comes up over the front casing cover. However, the second feed spool spring 20 does not come up over the front casing cover 3.

According to the present invention, the ink ribbon cartridge operates as follows:

As shown in FIGS. 1 and 12, the feed spool 5 is inserted into the space between the first feed spool spring 11 and the second feed spool spring 20 for tightly mating the upper portion 154 of the hub 18 of the feed spool 5 with both semi-circles 111 and 200 of the spool springs 11 and 20. At this time, the spring arm 22 engages in the space between the stoppers 23 and 24, 24 and 25, or 25 and 26 according to the tension of the second feed spool spring 20. For example, when the spring arm 22 is moved from the stopper 23 in the direction indicated by an arrow C, the extension arm spring 113 is moved to the upper portion in the direction indicated by an arrow D as shown in FIG. 12 so that the pressure of the upper portion 154 of the hub 18 of the feed spool 5 is increased for tightly keeping the feed spool 5 in the space between semi-circles 111 and 200. Thus, according to the position of the spring arm 22 it is determined how tight the semi-circle 200 of the second feed spring 20 holds the hub 18 of the feed spool 5. In addition, the jagged wheel 44 controls the speed of rotation of the winding spool 6. Thus, by both of the above-mentioned factors, the ink ribbon 7 to be used for typing is maintained at a constant tension.

The ink ribbon 7 from the feed spool 5 is connected to the winding spool 6 through the hook 12, and guide pins 8, 9, and 10. At this time, it is easy for the finger to attach the end of ink ribbon 7 to the hub 18 of the winding spool 6 through the gulf 34 (FIG. 1). Also, at this time, the lever 40 is locked by the lever opener 28.

When the ink ribbon 7 of the feed spool 5 is finally moved to the winding spool 6 as shown in FIG. 7, the exhausted feed spool 5 can be easily exchanged for a new one, and the winding spool 6 wound by the used ribbon 77 may also be removed from the cartridge 1. That is, when the finger stopper 29 is pushed into the outside of the cartridge 1, the lever end 41 is released from the lever opener 28 and the lever 40 can be pivotably moved from the original position to position A (dashed lines) in the direction indicated by an arrow as shown in FIG. 7. Also, the winding spool 6 wound by the used ribbon 77 is moved the original position at position B (dotted lines) in the direction indicated by an arrow as shown in FIG. 7. At this time, the used ink ribbon 77 can be readily taken out of the winding spool 6. Thereafter, the frame of the winding spool 6 can be reused by inserting it into the ribbon cartridge 1 and locking the lever opener 28. Accordingly, the used ribbon cartridge 1 can be easily reused.

As shown in FIG. 14, another embodiment of the ribbon cartridge according to the present invention operates as follows:

After the second feed spool spring 20 is moved down in the direction indicated by an arrow from the original position to the position M (dotted lines) as shown in FIG. 14, the feed spool 5 is inserted into the ribbon cartridge 1 through the feed spool side opening 14 and tightly contacted to the corner of the L-shaped bridges 221 and 223. At this time, the second feed spool spring 20 is returned to the original position and the extension arm spring is engaged within the space between the stoppers 25 and 26. Also, in order to give a tension to the ink ribbon 7, the ink ribbon 7 has to pass a spring end 227 of a pivotal spring 225 about a fixing pin 228 the other end spring 226 of the pivotal spring 225 biasing against the top cover 13.

As shown in FIGS. 16 and 17, the additional embodiment of the ribbon cartridge according to the present invention operates as follows:

After the second feed spool spring 20 is moved into the upper position, the feed spool 5 is inserted into the ribbon cartridge 1 through the space 301. Thereafter, the second feed spool spring 20 is tightly contacted to the portion disposed below the raised edge 152 of the hub 18 of the feed spool 5 and the extension arm spring 22 is engaged in the space of the stoppers 323 and 324 supported on the rear casing cover 3 (FIG. 16). At this time, the feed spool hub 18 comes up over the rear casing covers 3.

As shown in FIGS. 18 and 19, the other additional embodiment of the ribbon cartridge according to the present invention operates same as the ribbon cartridge in FIGS. 16 and 17. Only the second feed spool spring 20, the fixing pin 321, and the stoppers 323, 324, 325, and 326 are disposed within the ribbon cartridge.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A refillable ink ribbon cartridge for use in an electric typewriter and a printer which comprises:

a case housing including a casing base, a front casing cover, a top cover, a winding spool side wall, a feed spool side opening, and a bottom plate, said bottom plate having a bottom door, and said front casing cover having a hole disposed in the vicinity of said feed spool side opening, a plurality of pins disposed in said case housing and on the opposite side of said feed spool side opening, a changeable feed spool engaged within said case housing, said changeable feed spool having a hub and provided with a C-shaped first feed spool spring and a C-shaped second feed spool spring pivotably disposed in said case housing about said pins, respectively, for being symmetrically located adjacent to each other and for housing the hub of the feed spool in the space between said first and second feed spool springs, an ink ribbon, a replaceable winding spool engaged within said case housing in the vicinity of said changeable feed spool for winding said ink ribbon received from said feed spool, said replaceable winding spool provided with a pivotal connecting spring for connecting to a hub of the winding spool, a lever disposed in said bottom door for connecting to said pivotal connecting spring, a lever opener slidably disposed in the lower portion of said feed spool for locking and releasing said lever, means for transferring the ink ribbon from said feed spool to said winding spool, and a drive roller having a jagged wheel disposed within said housing means and in the vicinity of said winding spool for maintaining tension on the ink ribbon on the winding spool, whereby the feed spool can be inserted into and removed from the ribbon cartridge through the feed spool side opening and the winding spool can be replaced after removal of the used in ribbon wound about the winding spool so that the used cartridge can be reused and maintains a certain tension on the ink ribbon between the feed spool and winding spool.

2. The refillable ink ribbon cartridge of claim 1, wherein the top cover has a C-shaped configuration.

3. The refillable ink ribbon cartridge of claim 1, wherein the C-shaped first feed spool spring has a semicircle disposed in the center thereof for tightly contacting with the hub of the feed spool.

4. The refillable ink ribbon cartridge of claim 3, wherein the C-shaped first feed spool spring is provided with a plurality of holders supported on the casing base for alternatively holding the first feed spool spring.

5. The refillable ink ribbon cartridge of claim 1, wherein the C-shaped second feed spool spring has a semi-circle disposed in the center thereof for tightly contacting with the hub of the feed spool.

6. The refillable ink ribbon cartridge of claim 5, wherein the C-shaped second feed spool spring is provided with a plurality of stoppers supported on the inside surface of the front casing cover for receiving a spring arm extended therefrom for tightly holding the feed spool so as to control the tension thereof.

7. The refillable ink ribbon cartridge of claim 1, wherein a plurality of gulfs are disposed on said case housing and in vicinity of said feed spool and said winding spool, respectively, for easily handling the feed spool and the winding spool.

8. The refillable ink ribbon cartridge of claim 1, wherein the first and second feed spool springs make an angle of about 60° to 90° for easily inserting the feed spool into the housing.

9. The refillable ink ribbon cartridge of claim 1, wherein the pins are supported on said casing base.

10. The refillable ink ribbon cartridge of claim 1, wherein the transferring means comprises a hook formed at one end of said C-shaped first feed spool spring, and a plurality of pins supported on said casing base for tightly moving from the feed spool to the winding spool.

11. A refillable ink ribbon cartridge for use in an electric typewriter and a printer which comprises:

a case housing including a casing base, a front casing cover, a top cover, a winding spool side wall, a feed spool side opening, and a bottom plate, said bottom plate having a bottom door, and said front casing cover having a hole disposed in the vicinity of said feed spool side opening, a plurality of pins disposed in said case housing and on the opposite side of said feed spool side opening, a changeable feed spool engaged within said case housing, said changeable feed spool having a hub and provided with a plurality of bridges and a C-shaped second feed spool spring pivotably disposed in said case housing about said pins, respectively, for holding the hub of the feed spool in the space between one bridge of said bridges and said second feed spool spring, an ink ribbon, a replaceable winding spool engaged within said case housing in the vicinity of said changeable feed spool for winding said ink ribbon from said feed spool, said replaceable winding spool provided with a pivotal connecting spring for connecting to a hub of the winding spool and a lever disposed in said bottom door for connecting to said pivotal connecting spring, a lever opener slidably disposed in the lower portion of said feed spool for locking and releasing said lever, means for transferring the ink ribbon from said feed spool to said winding spool, and a pin supported on said casing base, a pivotal spring pivotably disposed in said housing means about said pin for maintaining tension on the ink ribbon on the winding spool, whereby the feed spool can be inserted into and removed from the ribbon cartridge through the feed spool side opening and the winding spool can be replaced after removal of the used ink ribbon wound about the winding spool so that the used cartridge can be reused and maintains a certain tension on the ink ribbon between the feed spool and winding spool.

12. The refillable ink ribbon cartridge of claim 11, wherein one bridge has an L-shaped configuration for tightly holding the hub of the feed spool.

13. The refillable ink ribbon cartridge of claim 11, wherein the C-shaped second feed spool spring has a semi-circle disposed in the center thereof for tightly contacting with the hub of the feed spool and is provided with a plurality of stoppers supported on the inside surface of the front casing cover for receiving a spring arm extended therefrom for tightly holding the feed spool so as to control the tension thereof.

14. The refillable ink ribbon cartridge of claim 12, wherein the C-shaped second feed spool spring is provided with a plurality of stoppers supported on said casing base for receiving a spring arm extended from the C-shaped second feed spool spring for tightly holding the feed spool so as to control the tension of the ink ribbon.

15. The refillable ink ribbon cartridge of claim 11, wherein a plurality of gulfs are disposed on said case housing and in vicinity of said feed spool and said winding spool, respectively, for easily handling the feed spool and the winding spool.

16. The refillable ink ribbon cartridge of claim 11, wherein the transferring means defines a hook formed at one end of said pivotal spring and a plurality of pins supported on said casing base for tightly moving from the feed spool to the winding spool.

17. A refillable ink ribbon cartridge for use in an electric typewriter and a printer which comprises:

a case housing including a casing base, a front casing cover, a top cover, a winding spool side opening, and a bottom plate, said bottom plate having a bottom door, and said front casing cover having an elongated hole disposed in the vicinity of said feed spool side opening, a pin disposed in said case housing and in the vicinity of said feed spool side opening, a changeable feed spool engaged within said case housing with said elongated hole by a hub thereof, said changeable feed spool being provided with a C-shaped second feed spool spring pivotably disposed on said front casing cover about said pin for holding the hub of the feed spool in the space between one end of said first and elongated hole and said second feed spool spring, an ink ribbon, a replaceable winding spool engaged within said housing means in the vicinity of said changeable feed spool for winding said ink ribbon from said feed spool, said replaceable winding spool provided with a pivotal connecting spring for connecting to a hub of the winding spool, a lever disposed in said bottom door for connecting to said pivotal connecting spring, a lever opener slidably disposed in the lower portion of said feed spool for locking and releasing said lever, means for transferring the ink ribbon from said feed spool to said winding spool, and a drive roller having a jagged wheel disposed within said housing means and in the vicinity of said winding spool for maintaining tension on the ink ribbon on the winding spool, whereby the feed spool can be inserted into and removed from the ribbon cartridge through the feed spool said opening and the winding spool can be replaced after removal of the used ink ribbon wound about the winding spool so that the used cartridge can be reused and maintains a certain tension on the ink ribbon between the feed spool and winding spool.

18. The refillable ink ribbon cartridge of claim 17, wherein the C-shaped second feed spool spring is provided with a plurality of stoppers supported on the outside surface of the front casing cover for receiving a spring arm extended the C-shaped second feed spool spring for tightly holding the feed spool so as to control the tension thereof.

19. The refillable ink ribbon cartridge of claim 18, wherein the pin and the plurality of stoppers are disposed on the inside surface of the front casing cover for receiving the spring arm extended therefrom for tightly holding the feed spool so as to control the tension thereof.

20. The refillable ink ribbon cartridge of claim 17, wherein the transferring means comprises a hook formed at one end of said C-shaped first feed spool spring, and a plurality of pins supported on said casing base for tightly moving from the feed spool to the winding spool.

* * * * *